US007547269B2

(12) United States Patent
Munson, Jr.

(10) Patent No.: US 7,547,269 B2
(45) Date of Patent: Jun. 16, 2009

(54) METHOD AND APPARATUS FOR PHYSICAL FITNESS TRAINING

(75) Inventor: David Munson, Jr., Dallas, TX (US)

(73) Assignee: FOI Group, LLC, Dallas, TX (US)

( * ) Notice: Subject to any disclaimer, the term of this patent is extended or adjusted under 35 U.S.C. 154(b) by 635 days.

(21) Appl. No.: 10/737,018

(22) Filed: Dec. 16, 2003

(65) Prior Publication Data

US 2004/0127338 A1 Jul. 1, 2004

(51) Int. Cl.
*A63B 21/008* (2006.01)

(52) U.S. Cl. ..... 482/112; 482/111; 73/379.09

(58) Field of Classification Search ..... 482/92, 482/111–113; 73/379.01, 379.09
See application file for complete search history.

(56) References Cited

U.S. PATENT DOCUMENTS 3,081,634 A * 3/1963 Blaszkowski ..... 73/379.09
4,911,436 A * 3/1990 Lighter ..... 482/113
4,969,643 A * 11/1990 Kroeker et al. ..... 482/112
5,190,511 A * 3/1993 Petree ..... 482/112
6,413,195 B1 * 7/2002 Barzelay ..... 482/112
6,679,812 B2 * 1/2004 Torkelson ..... 482/51
6,918,862 B1 * 7/2005 Comeau ..... 482/111
7,207,930 B2 * 4/2007 Bonutti ..... 482/111
7,226,401 B2 * 6/2007 Van Stratten et al. ..... 482/112

* cited by examiner

*Primary Examiner*—Glenn Richman
(74) *Attorney, Agent, or Firm*—D. Scott Hemingway; Hemingway & Hansen, LLP

(57) ABSTRACT

An improved method and apparatus for physical strength, agility and endurance training uses fluid jet reaction forces to train and strengthen muscles. The device for physical training includes a source of pressurized fluid connectable through a hose to a propulsion system and one or more apertures or nozzles for forming one or more jets of fluid that are discharged from the propulsion system such that a nozzle reaction force, acting in a direction opposite the direction of the jet stream, is exerted on the jet propulsion system. Fluid can also be delivered through a curved tube or passage in the propulsion system such that a stream of fluid that is discharged from the propulsion system is not traveling in the same direction as it was before it was discharged such that the change in direction of the fluid causes a change in the momentum of the fluid for exerting an additional reaction force on the propulsion system. A user engaging mechanism, connected to the propulsion system, is configured to transmit exercise forces to a user. The device includes controls for controlling the magnitude and direction of the reaction force vector applied to the user engaging mechanism. Various embodiments of user engaging members, including blocking dummies, handles, gloves, helmets, shoes, straps or balls, may be attached to the propulsion system.

19 Claims, 6 Drawing Sheets

METHOD AND APPARATUS FOR PHYSICAL FITNESS TRAINING

FIELD OF INVENTION

The present invention is generally related to a method and apparatus for physical fitness training, and more particularly to a method and apparatus that utilizes a pressurized fluid to provide dynamic controllable physical training for strengthening and rehabilitating muscles.

BACKGROUND

Traditional strength training devices are severely limited by design and physics. A variety of methods have been developed over time to strengthen and tone muscles for both health and athletic activity. Conventional exercise emphasizes, and often requires, slow steady movement. In existing devices the forces are generated by weights, springs, or friction and accompanied by the limitations of these force generating methods. These force generating devices are restricted by direction, speed or fixed location. The oldest and most widely used method of strength training is the use of gravitational forces either as "free" weights or as part of an exercise machine. While the countless variations continue to grow, the limitations of weight training remain. Gravitational forces developed by a mass and the kinetic energy of a mass varying with the square of the velocity are both the means and the limits on weight based training. These limitations can result in injury, strengthen slow response muscles and impose higher exercise forces on faster movement.

On the other hand, spring type devices offer a lighter way to generate forces and thus do not have the kinetic energy issues. They have numerous limitations of their own and have not found wide acceptance in athletic training rooms.

Friction type devices are velocity sensitive and exert no forces at a standstill. Some devices use hydraulic dampers as the friction mechanism. One of the largest friction devices is the football blocking sled.

None of the existing devices can simulate athletic conditions or stimulate and develop the quick response muscles required for athletic success. Limitations of existing devices pose additional hazards in rehabilitation therapy.

The limitations of existing exercise equipment make the practice session the most effective method of preparing athletes for competition. This practice endangers player health as the excitement and uncontrollable nature of athletic activities can result in players getting injured. Even when professional players are well matched, drills such as blocking and tackling can aggravate old injuries and cause new ones. Numerous passive devices have been constructed to assist coaches and trainer to improve athletes. The predictability of these devices is their main drawback. The athletic contest is not predictable.

Additionally, instructional devices for athletes have been used that offer limited movement and control of parts of the devices. For example, Burke, et al., U.S. Pat. No. 2,602,666 discloses a blocking dummy, mounted on a trolley that is movable longitudinally of a track. A manual switch is provided for releasing a latch to permit a spring to forcibly and rapidly draw the trolley longitudinally of the track. Foster, et al., U.S. Pat. No. 3,062,548 discloses cylindrical padded members, mounted on a cart having wheels which drive a hydraulic pump for moving hydraulic fluid through a control valve. Kipp U.S. Pat. No. 3,062,547 discloses a defensive reaction football training sled, controlled by the coach. Pate U.S. Pat. No. 5,555,091 and Ballad U.S. Pat. No. 5,752,899 disclose exercise devices submerged in water to resist movement.

Thus, there exists a need for interactive training equipment which would develop strength, agility, and endurance, with reduced risk of injury.

SUMMARY OF INVENTION

In order to overcome the inherent problems in existing exercise equipment and achieve other objects of the invention, this device for physical training is directed to a method and apparatus for developing and controlling exercise forces that are more closely similar to the efforts required in sports. The device for physical training utilizes a jet propulsion system that includes one or more apertures or nozzles for forming a jet of fluid that is discharged from the jet propulsion system for the purpose of producing a nozzle reaction force vector, which acting in the opposite direction of fluid discharge is exerted on the jet propulsion system and the attached user engaging mechanism In a preferred embodiment, the device includes controls for controlling the magnitude and direction of the nozzle reaction force applied to the user engaging mechanism by the jet propulsion system. Additional forces can be created by utilizing a curved tube in the propulsion system such that a stream of fluid that is discharged from the propulsion system is not traveling in the same direction as it was before it was discharged such that the change in direction of the fluid is a change in the momentum of the fluid producing an additional reaction force. The forces utilized by the invention are force vectors constrained only by the direction and magnitude of the jet stream and unchanged by location, direction or movement of the device. This freedom from constraint allows new and improved training methods to be utilized. Because the forces are generated without any fixed attachment point, workout area and devices design is limited only by budget and training needs.

The fluid jet training device can be designed to train and strengthen muscles for both rehabilitation and physical fitness. It can be used in air, or underwater depending on whether the goal is to strengthen fast response muscles or do general fitness and rehabilitation. Fast movement is inherently difficult in water thus athletic training would generally be done either in very shallow water or on a dry surface.

While the present invention is applicable to training for any sport, however, the present invention is particularly useful when adapted to football training. All football players require quick response strength conditioning to succeed on the field. Linemen in particular require an exercise regimen that strengthens their explosive lateral thrust. Movement and generated forces of the jet training device simulates the live action of a superior opponent without the risk of injury that accompanies live scrimmage. Movement and forces can be precisely controlled by the trainer to quickly and efficiently provide the type of training needed by an individual athlete. Because the forces generated are both independent of any attachment point and capable of rapid changes in force direction and magnitude an athlete must use quick reaction muscles to keep in control.. Different forces and user engaging mechanisms would be used for different players. The forces required to train a lineman would be much greater than the forces used by a receiver, yet both players benefit from the degrees of freedom offered by this device. Unlike traditional methods the forces used by the invention are quickly controllable and measurable. Progress can be tracked automatically. It is possible to vary the force based on given training goals.

For example the faster the user moves the force can proportionately be reduced. This is what happens on the field. A player that has the quick burst escapes or makes the tackle while the sluggish one doesn't.

The advantages offered by the fluid jet training device can be used to not only train athletes in any sport but to offer particular advantages for rehabilitation of injury. Because the forces created depend on both velocity and volume of the fluid stream they can be changed or stopped very quickly, this allows aquatic rehabilitation of a patient that does not rely on movement or speed to generate exercise forces. Unlike other devices which rely on movement to generate resistance, or weights or springs, the forces generated are unchanged by direction or movement. This encourages faster movement and the resulting calorie use and improved fitness. In the case of severely injured or obese patients their limbs can be moved about in the water without injury using very small forces. Some users could control the jet(s) themselves or use an automatic program. Furthermore the kinetic energy of the system is low relative to force protecting the user from injury and allowing exercise to be conducted at a fast or slow pace depending on the need. Just as it is easier to lift a constrained weight on a machine than to do a traditional bench press, the fluid jet training device is even more effective at exercising users, necessitating much lower forces. While lower forces are needed for exercise more muscles are exercised.

DETAILED DESCRIPTION OF PREFERRED EXAMPLE EMBODIMENTS

As will be hereinafter more fully explained, use of the illustrated apparatus provides a method that utilizes fluid reaction forces to provide dynamic controllable physical training for strengthening and rehabilitating muscles. The exercise device includes an attachment means for transferring exercise forces to a user from the device, an input for delivering fluid to the device and jet propulsion output for discharging a stream of fluid from the device. A user engages the exercise device via the attachment means. Then, fluid is delivered through an input to a jet propulsion system and discharged from the propulsion system via the nozzle output. When fluid is delivered through the input and dispensed through the propulsion system, the propulsion system exerts a reaction force on the attached user in a direction opposite the direction of the jet stream.

Figure 1:
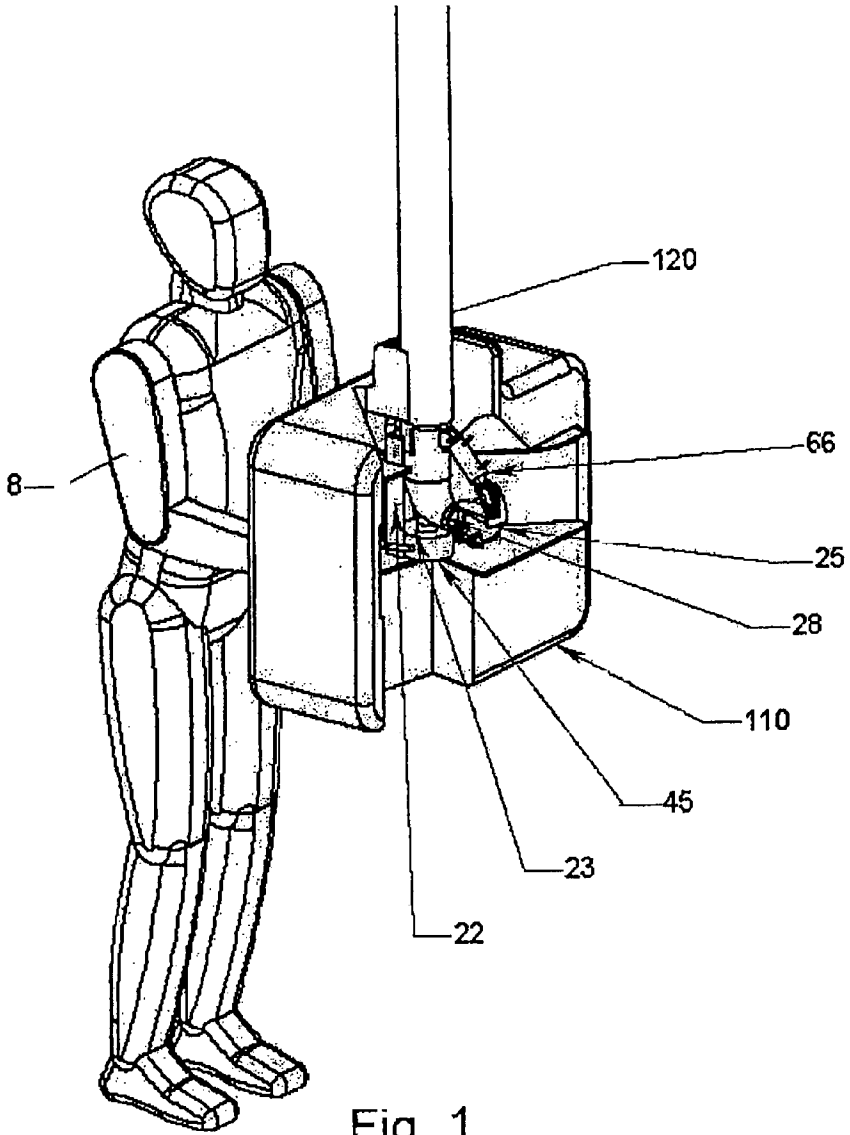
FIG. 1 is a partially cut-away perspective view illustrating an example water jet exercising device according to the present invention.
Figure 2:
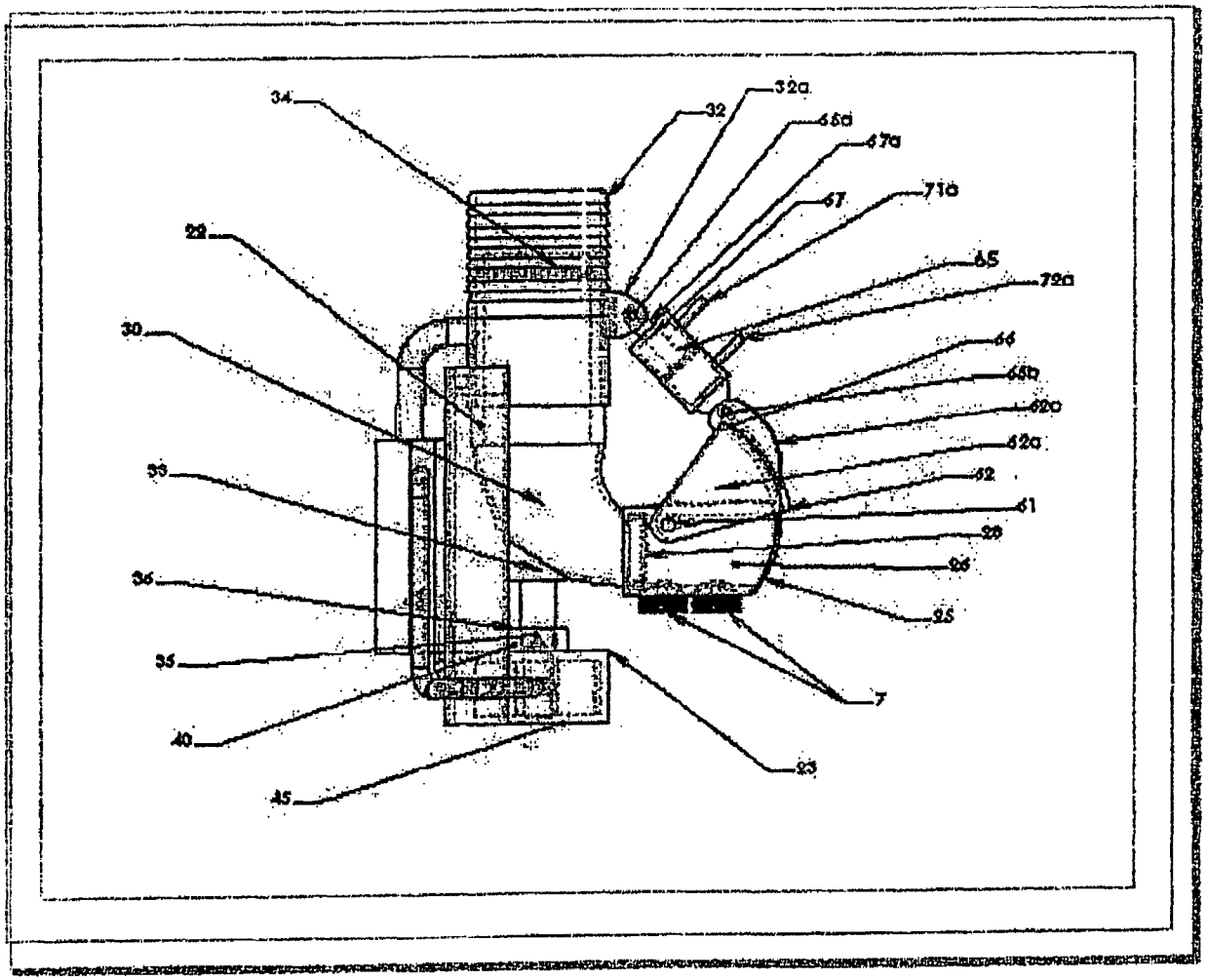
FIG. 2 is a cross-sectional view of the propulsion system of the present invention.

Referring to FIGS. 1 and 2 of the drawings, the number 20 generally designates a jet propulsion system having a jet mounting frame 22 which carries a nozzle assembly 25 and apparatus 45 for controlling the direction the nozzle assembly dispenses a stream of fluid through an orifice. Nozzle assembly 25 includes a smooth bore nozzle 26 threadedly secured in an internally threaded sleeve 28. Sleeve 28 is formed on one end of a curved transition tube 30 having a spindle portion 32 rotatably secured to a swivel joint body 34 bolted or otherwise secured to jet mounting frame 22.

Transition tube 30 has a boss 33 which has a reduced diameter section configured to form a shaft 35 extending downwardly from transition tube 30. A shoulder 36 between boss 33 and shaft 35 engages the inner race of a thrust bearing 40 which has an outer race supported on mounting plate 23 secured to jet mounting frame 22.

The Jet propulsion system 20 is provided with a gate valve 60 formed by a curved shutter plate 62 on arms 62*a* and 62*b* pivotally secured by a pin 61 to sleeve 28.

In the illustrated embodiment, gate valve actuator 65 is a double acting hydraulic cylinder 66 having a piston 67 and piston rod 67*a* with pressure chambers on opposite sides of piston 67 communicating with supply lines 71*a* and 72*a*. The hydraulic cylinder transforms the pressure and fluid flow in the hydraulic system into work or mechanical force. While hydraulic actuator 65 is a double-acting cylinder, that is, fluid under pressure can be applied to either side of the piston 67 to provide movement in either direction, a single acting cylinder biased to the failsafe position may be used, if it is deemed expedient to do so.

Hydraulic cylinder 66 is pivotally connected by a pin 65*a* to a lug 62*a* on shutter plate 62 and piston rod 67*a* is pivotally connected by a pin 65*b* to a lug 32*a* on spindle 32. Gate valve actuator 65 is operable to raise and lower the shutter plate 62.

In one embodiment, the propulsion system 20 can be connected to receive fluid from a source of pressurized fluid. The curved transition tube is configured such that a stream of fluid that is discharged from the propulsion system 20 is not traveling in the same direction as it was traveling before it was discharged such that the change in direction of the fluid is a change in the momentum of the fluid for exerting a reaction force on propulsion system 20.

The transition tube has a boss that has a reduced diameter section configured to form a shaft extending downwardly from the transition tube. A shoulder between the boss and shaft engages the inner race of a thrust bearing which has an outer race supported on mounting plate 23 secured to jet mounting frame 22.

In one embodiment, the method that controls the direction of the jet of fluid that is discharged from the transition tube through the nozzle is a hydraulic actuator. As shown in FIGS. 1 and 2, the hydraulic actuator is a vane motor which includes a motor housing bolted or otherwise secured to the lower end of jet mounting frame 22 below mounting plate 23. A rotor in the motor housing has at least one rotating vane secured thereto and at least one static vane which extends inwardly from the inner wall of the motor housing.

Rotating vanes on the rotor and static vanes on the motor housing divide the interior of the motor housing into chambers for forming a reversible hydraulic actuator apparatus. The rotor is secured by a key to the end of the shaft. The rotor, shaft, transition tube and spindle portion of the jet propulsion system 20 are axially aligned and rotate about a common axis.

However, as those skilled in the art can readily appreciate, other types of motors may be used instead of the vane motor. Small electric motors such as those commonly used in electric drills may be used instead of the vane motor. The equivalent functionality may also be accomplished manually.

Jet propulsion system 20 is provided with a gate valve formed by a curved shutter plate on arms pivotally secured by a pin to sleeve 28. A gate valve actuator is provided for moving the shutter plate between the operative position and a closed position. In the illustrated embodiment, the gate valve actuator is a double acting hydraulic cylinder 66 having a piston and piston rod with pressure chambers on opposite sides of the piston communicating with supply lines. The hydraulic cylinder transforms the pressure and fluid flow in the hydraulic system into work or mechanical force. While hydraulic actuator is a double-acting cylinder, that is, fluid under-pressure can be applied to either side of the piston to provide movement in either direction, a single acting cylinder biased to the failsafe position may be used, if it is deemed expedient to do so. The hydraulic cylinder 66 is pivotally connected by a pin a to a lug a on a shutter plate and the piston rod is a pivotally connected by a pin to a lug on the spindle. The gate valve actuator is operable to raise and lower the shutter plate.

Referring to FIG. 2, a control valve, which controls movement of the gate valve actuator, is connected to the supply lines. The control valve is a spool valve having a valve body, two outlet ports connected through lines communicating with chambers inside cylinder 66 adjacent opposite sides of the piston. Outer ends of the valve body have vent or drain ports formed therein. A spool is slidably disposed in the valve body and a pressure port is formed in a central portion of the outer body.

The spool has an open central portion formed between the valve lands. The spool is biased toward the position in which the pressure port and the port are in fluid communication with each other. When the spool is actuated to the right, the pressure port is in communication with the port and the fluid is delivered through the line for delivering pressure to the closed end of cylinder 66 for applying pressure and for extending the rod to rotate the shutter plate to the position for blocking flow from the jet. This is the failsafe position to terminate application of the forces tending to move the jet propulsion system 20 in a horizontal direction.

When the spool is shifted to the left, the pressure port is in communication with the port and the fluid is delivered through the line to the rod end of cylinder 66, while fluid is expelled through the line, the port and the vent passage.

The gate valve actuator control valve is preferably remote controlled and in the illustrated embodiment is a solenoid actuated spool valve controlled by a solenoid. The spool is urged by a spring or other suitable biasing mechanism to the failsafe position. It should be appreciated that the spool valves can be operated manually, electrically, or by fluid pressure.

In one embodiment, the nozzle in jet propulsion system 20 receives fluid from a fluid source. The fluid source includes a pump, driven by a prime mover, a surge tank (accumulator), a pressure relief valve, an emergency shut off valve, a reservoir, and a flow control valve 110, all of which are connected by a pressure supply line 120 which is connected to the swivel joint body of jet propulsion system 20.

In one embodiment of the system, the pump is a centrifugal pump which operates using kinetic energy to move the fluid. The centrifugal pump offers the shock absorbing advantages of a non-positive displacement pump. It is contemplated that vane, gear, gerotor or piston pumps may be used in lieu of the centrifugal pump.

The pump is driven by any suitable prime mover. In fixed installations, the prime mover may be an electric motor or an internal combustion engine. In mobile installations, the prime mover is likely an internal combustion engine. The prime mover is preferably a variable speed device for driving the pump at variable speeds to control the flow rate of fluid delivered to the jet propulsion system 20. In a multiple user installation, multiple pumps may be used to allow needed varying fluid volumes to be pumped at a high efficiency. In the illustrated embodiment, the prime mover has a drive shaft connected through a clutch to the drive shaft of the pump. The clutch is can be a variable speed clutch, the output of which can be remotely controlled to adjust the output of the pump.

As those skilled in the art can readily appreciate, various other engagement means are available for propelling the fluid and may be used with the present invention. Furthermore, instead of water or other liquid, a propulsion system using a gas may be used.

The surge tank comprises any suitable accumulator used to store fluid under pressure, and to absorb excess fluid flow created upon valve closure while the pump is unloaded. This fluid is also used to supplement the power pump output during times of heavy use or for limited operations when the pump is not working. During high force short duration exercise a large accumulator allows the pump to operate at a more constant output. The accumulator dampens surges within the hydraulic system. In some locations it may be possible to utilize a fluid tower, elevated tank, or any high head fluid source to provide the pressurized fluid needed.

Additionally, a flow control valve can be added to the exercise device. The flow control valve is a remotely actuated valve which controls the volume or rate at which fluid is delivered through high pressure supply line 120. Another safety device, a pressure relief valve can be added to the exercise device. The pressure relief valve, once adjusted, opens whenever the pressure exceeds the value set and allows fluid to flow back to the reservoir.

In operation, a user engages the exercise device via the attachment means. Then, fluid is delivered through the input to the jet propulsion system and discharged from the propulsion system via the nozzle output. This causes the propulsion system to exert a reaction force on the attached user for strengthening and rehabilitating the user's muscles. Variable direction and pressure of the fluid discharged from the propulsion system, can be manually controlled by the user or a third party. Varying the direction and pressure of the fluid discharged from the propulsion system allows a user to strengthen and rehabilitate a wide variety of muscles.

Figure 3:
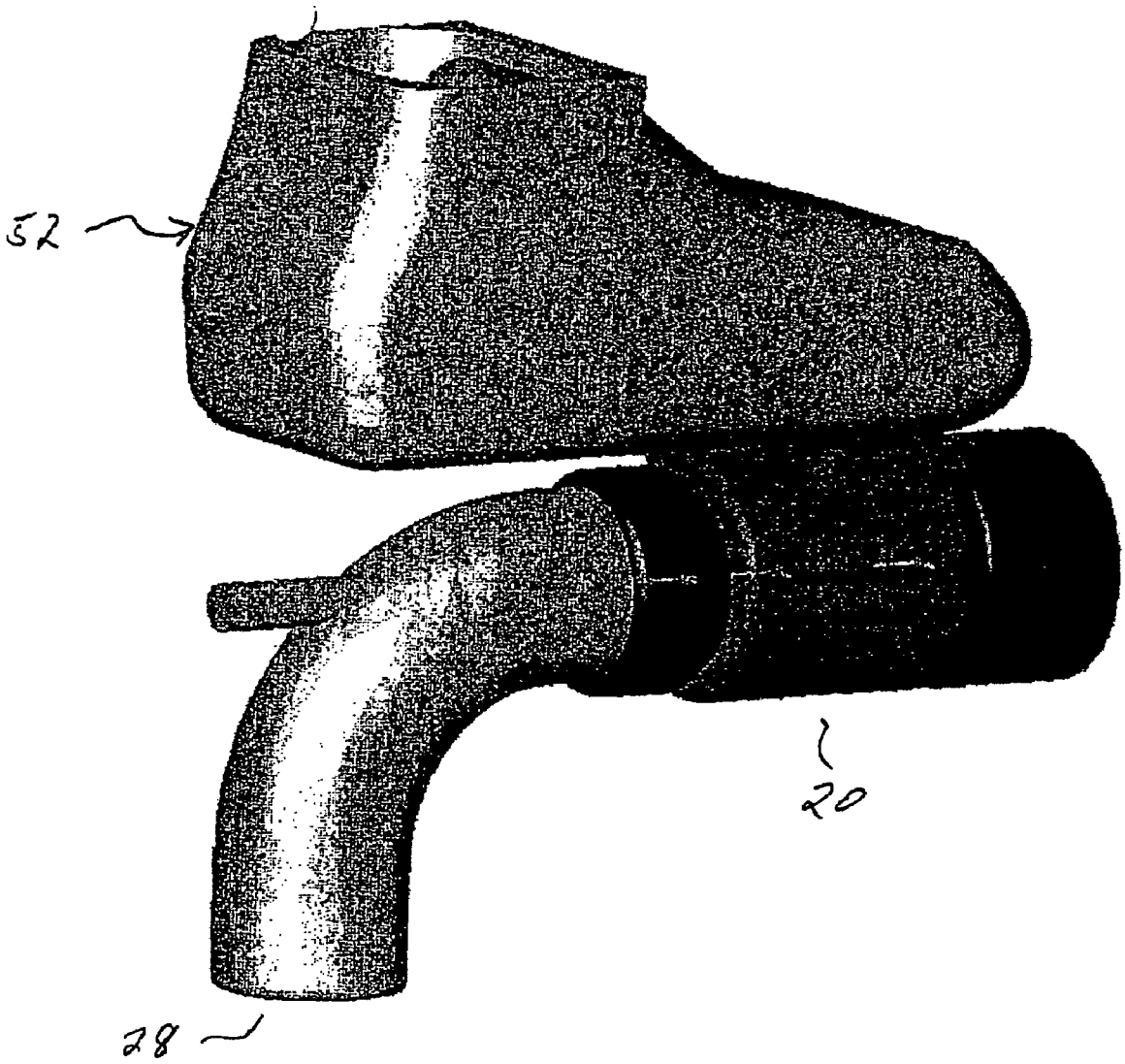
FIG. 3 is a diagrammatic view of the exercise device of the present invention mounted on a shoe.
Figure 5:
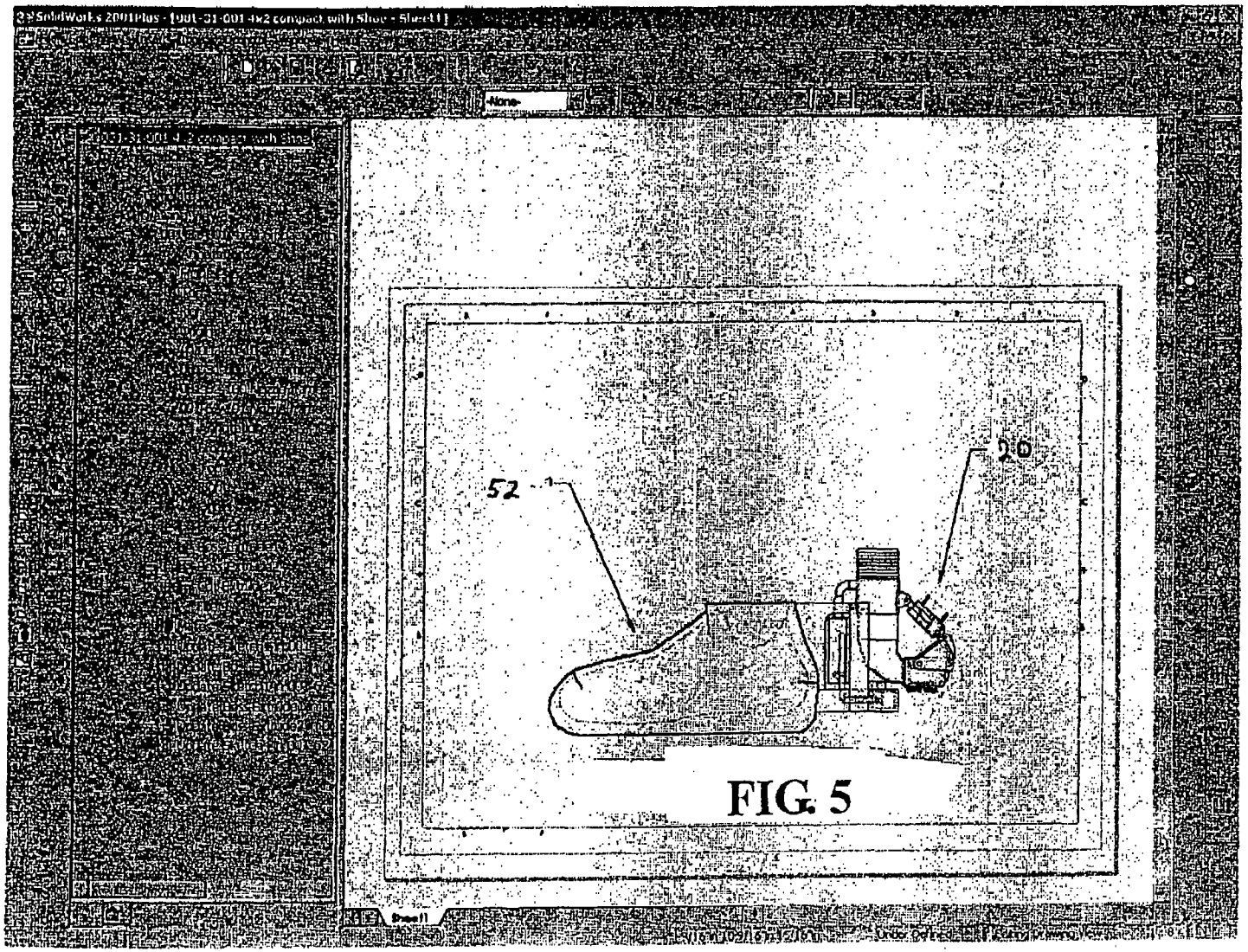
FIG. 5 is a diagrammatic view of an alternative embodiment of the exercise device of the present invention mounted on a shoe.

In one embodiment, the attachment means of the exercise device allows the jet propulsion system 20 to be mounted on a boot or shoe 52, as shown in FIGS. 3 and 5. Here, the propulsion system 20 operates in much the same manner, fluid is delivered through the input and discharged from the propulsion system. The discharged fluid causes the propulsion system to exert a reaction force on the attached user to propel the exercise device in a direction opposite the direction of the jet stream. The exercise device would then be used to strengthen a user's leg muscles for rehabilitation or exercise.

Figure 4:
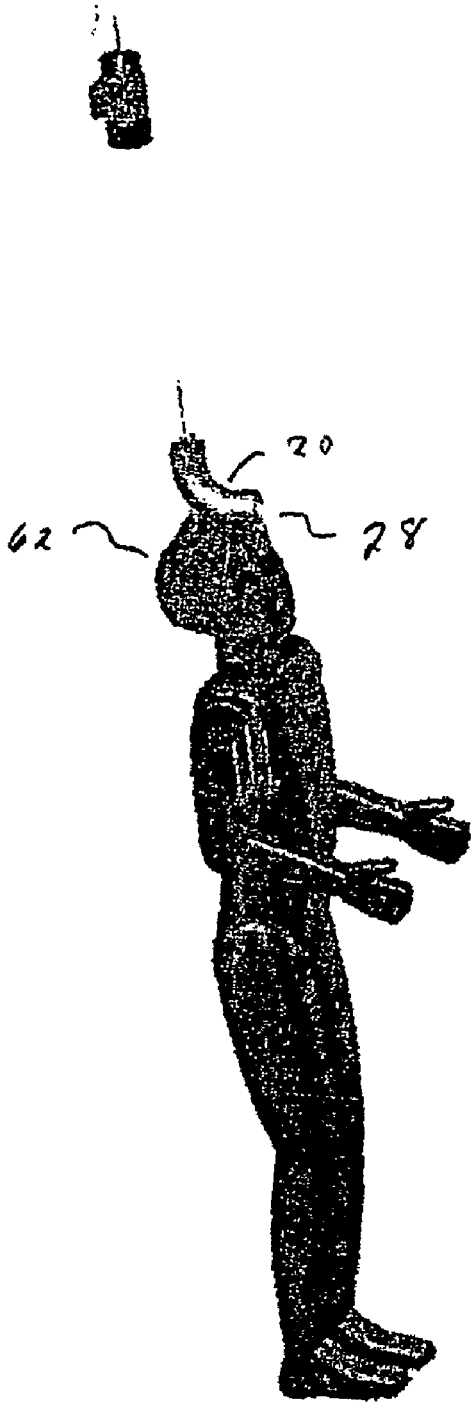
FIG. 4 is a diagrammatic view of the exercise device of the present invention mounted on a helmet.

In another embodiment, the attachment means of the exercise device allows the jet propulsion system 20 to be mounted on a helmet or other headgear 62, as shown in FIG. 4. Here, the fluid is again delivered through an input and discharged from the propulsion system, causing the propulsion system to exert a reaction force on the attached user and propel the apparatus in a direction opposite the direction of the jet stream. The exercise device would then be used to strengthen a user's neck muscles for rehabilitation or exercise.

Figure 6:
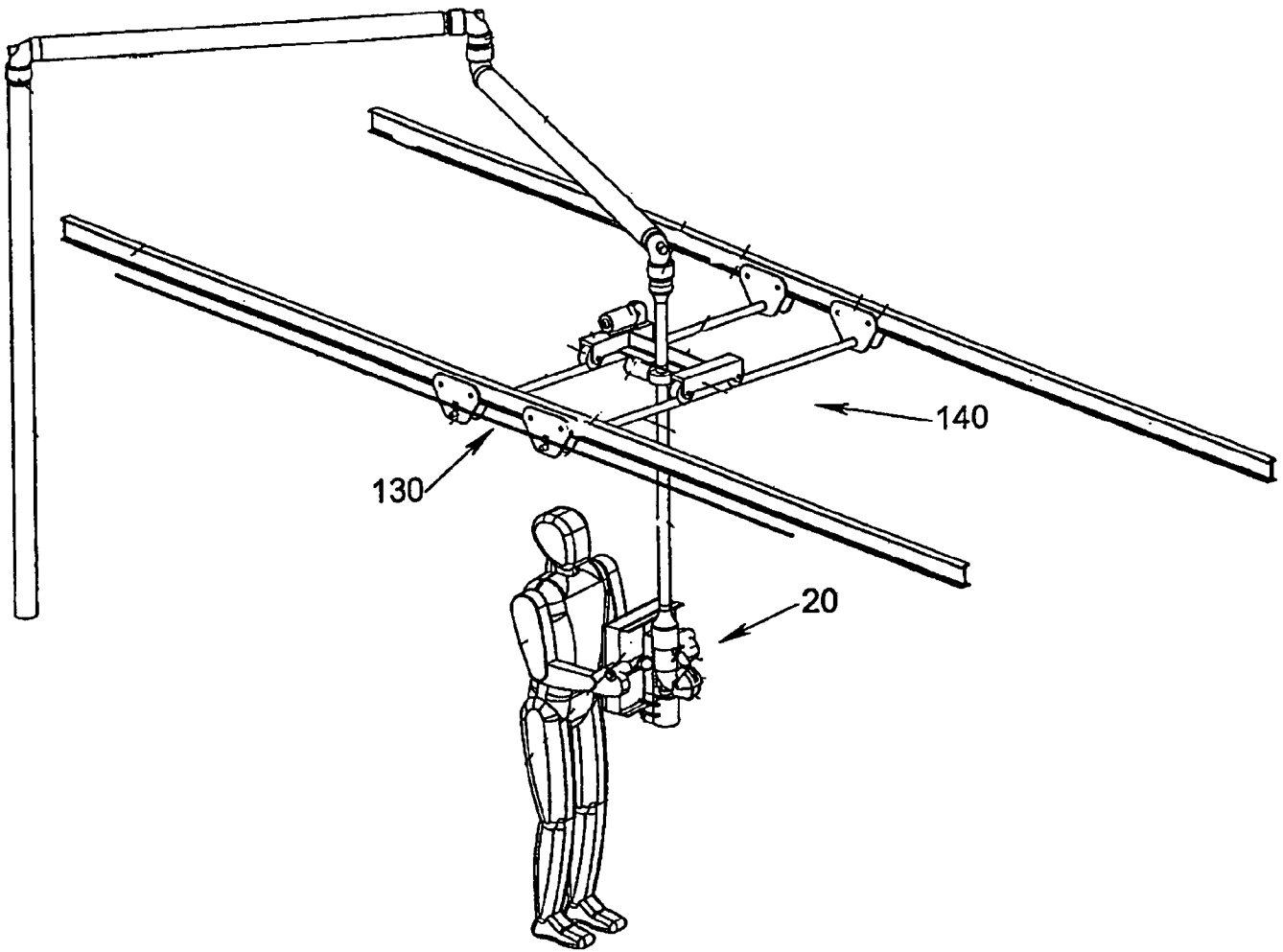
FIG. 6 is a view of an embodiment of the present invention wherein the invention is coupled to a set of overhead tracks.

In another embodiment, as shown in FIG. 6, the attachment means of the exercise device allows the jet propulsion system 20 to be Mounted on an overhead trolley system. Here, the exercise device includes a fluid holding tank, which in this embodiment of the invention is a reservoir. The reservoir is formed by four side walls and a bottom secured together to form a generally rectangular shaped reservoir or catch basin. Four corner posts extend upwardly from the corners of the reservoir and have upper ends joined by top rails. The top rails form trolley guide rails, as will be hereinafter fully explained. Pressurized fluid is delivered to flexible supply hose through a swivel pipe assembly, comprising combination of swivels, rigid pipes and flexible hose. As shown in FIG. 6, the swivels are generally L-shaped having a first end configured to be threadedly secured to a threaded connector and a second end provided with a swivel joint which is connected to a second pipe or hose to permit relative pivotal movement of the connected members. Pressurized fluid is delivered to swivel through a stand pipe and fluid communication with the pump.

In this embodiment, the exercise device consists of an overhead trolley system to allow the fluid jet exerciser to move freely in two directions and be moved along a vertical axis for optimum exercise effectiveness. A longitudinal trolley, generally designated by the numeral 130, is moved longitudinally on the guide rails by a friction wheel turned by a reversible variable speed electric motor. A transverse trolley 140 is moved by a friction wheel turned by a reversible variable speed drive motor longitudinally on guide bars. A vertical lift mechanism is mounted for moving fluid supply hose vertically relative to longitudinal trolley 130 and transverse trolley 140. It should be appreciated that the jet propulsion system 20 is suspended from the end of the hose, thus the purpose of the trolley drive system is not to impart significant exercise forces to the user, but to maintain the hose in a nearly vertical orientation. This allows substantial movement both longitudinally and transversely, without the change in vertical elevation that would occur if hose were to swing from a fixed point. It is should be readily apparent that for most training uses which do not require large horizontal movements that the overhead trolley could be left stationary or in some cases the supply hose could be supported by a fixed attachment instead.

Additionally, suitable controls are provided to permit a coach or trainer to either manually or automatically actuate the motor for moving longitudinal trolley 130 which results in movement of the hose which supports the jet propulsion system 20 toward or away from the user. Likewise actuation of the transverse trolley motor, either manual or automatic, moves the transverse trolley to the user's right and left. In an automatic mode, the trolleys 130 and 140 move in response to sensor switches (not shown) that ensure that the hose 120 remains nearly vertical. Manual control allows the operator to position the jet propulsion system for exercise and to assist in the installation of different user engaging mechanisms. Actuation of the vertical lift mechanism will elevate the propulsion system 20 relative to the user. This can be done as part of the exercise or before to adjust the device to the desired elevation.

The longitudinal trolley, generally designated by the numeral 130, comprises spaced trolley guide bars having opposite ends secured between spaced carriages. Each carriage has spaced rollers at opposite ends thereof which engage trolley guide rails while trolley guide bars span the space between the guide rails. Longitudinal trolley 130 can be driven longitudinally on the guide rails preferably by a drive wheel powered by a reversible variable speed electric motor.

The transverse trolley 140 includes a pair of spaced carriages, each of which has rollers rotatably secured to each end thereof. A hanger, formed of a generally angled shaped member has opposite ends welded or otherwise secured to carriages for maintaining the carriages in spaced apart relation for movement of rollers along the guide bars. A trolley drive motor can be mounted on the carriage and has a drive shaft drivingly connected to one of the rollers on the carriage. The motor is preferably a reversible variable speed motor mounted for moving transverse trolley 140 longitudinally on the guide bars. It is readily apparent that many other overhead trolley configurations or other means might be used to allow the device to translate freely through the desired exercise area.

Optionally, a vertical drive motor is mounted on the hanger for moving supply hose vertically relative to longitudinal trolley 130 and transverse trolley 140. It should be appreciated that the jet propulsion system 20 is suspended from the end of said supply hose. Actuation of the motor will elevate the propulsion system 20 relative to the user. Thus, the user engaging mechanism on the propulsion system 20 is movable vertically independently while the propulsion system 20 exterts forces on the user in selected directions in the horizontal plane. Furthermore it is readily apparent that the ability to change elevation allows more different configurations and exercise methods.

When the fluid is delivered through propulsion system 20, the user engaging mechanism suspended from the end of hose will be propelled in a direction opposite the water stream.

From the foregoing it should be readily apparent that the exercise device hereinbefore described has a capability of translating horizontally freely and moving vertically relative to the user. When water or other suitable fluid is delivered through hose and dispensed through the jet propulsion device 20 the user engaging mechanism will apply forces on the user that can change in magnitude and direction controlled by the coach, trainer, physical therapist, or other medical professional. The force exerted by propulsion system 20 and the user engaging mechanism is controlled by the regulation of pressure and flow rate of the fluid through supply line. The force direction is controlled by controlling the direction of the jet stream.

It should be readily apparent that this device can be mounted in a variety of configurations depending on the user needs. A permanent installation might for example be mounted above a floor sloping toward a therapy pool which would function as a reservoir and additionally as an area for use in water. It should be apparent that a version for water use could just use a floating hose to supply the jet propulsion system. In the alternative, the apparatus may be mounted on a trailer or skid to provide a mobile installation which can be moved on and off of a practice field or from one practice facility to another, for example for different schools.

The present invention preferably includes a control system, (not shown) which can either be console mounted, with gauges that indicate flow rate, pressure in line 120 and the calculated force for a selected nozzle or set up for wireless remote control. It can be equipped with a joystick controller, (not shown), to be manipulated by a coach or trainer to control movement and force. The system is preferably programmed to reduce fluid flow when device has moved out of the desired work out zone. Cutoff switches to prevent operation without user engagement must be installed for safety in higher force applications when the device could accelerate at more than 1 G. These switches, also known as deadman switches would shut the gate valve or other cutoff valve if the user were not engaged. Additionally safety restraining straps can also be included as well or instead of deadman valves, to prevent uncontrolled motion.

The forces generated are a combination of nozzle reaction forces and change of momentum forces. Field measurements have shown that unknowns including near boundary layer effects and other factors mitigate the usefulness of simple fluid calculations.

The velocity of fluid discharged through a nozzle is equal to the square root of 2 gh where h is the effective head pressure in height. The quantity of fluid discharged is equal to the velocity times the area of the orifice. The nozzle reaction force R=2 pa or R=1.57 $d^2p$.

It should be readily apparent that as fluid pressure increases more fluid is discharged through a given orifice, and the nozzle reaction force rises as well.

As can be seen from the following table showing field measurements using a 2-inch orifice the forces generated are significant. The forces shown reflect both change of momentum and nozzle reaction forces. While the forces shown may sound low compared to the higher weights used in weight rooms, the freedom of motion and direction increases the difficulty by about a factor of three or more. Additionally as the user is not necessarily restrained by a bench, seat or floor as in traditional exercise this is really free force exercise just like athletic competition.

| Force (in pounds) | Flow (in gpm) | Pressure (in psi) | Theoretical Flow | Efficiency |
|---|---|---|---|---|
| 36 | 291 | 13 | | |
| 36 | 291 | 13 | | |
| 78 | 448 | 29 | 655 | 68% |
| 98 | 506 | 35 | 708 | 72% |
| 130 | 581 | 47 | 801 | 73% |
| 172 | 681 | 64 | | |
| 187 | 705 | 67 | 964 | 73% |

When pressure is increased across a two-inch diameter orifice from 13 PSI to 67 PSI the nozzle reaction force increases from about 35 pound to about 187 pounds. As can be seen the force produced a not a linear function. Boundary layer effects, the different speed of the water in curved delivery tube and at nozzle, nozzle roughness(very) and pump fluctuations contribute to lower performance. A more advanced design should have a nozzle efficiency of more than 90% of theoretical not 70%

Terms such as "left," "right," "horizontal," "vertical," "up" and "down," when used in reference to the drawings, generally refer to the orientation of the parts in the illustrated embodiment and not necessarily during use. These terms used herein are meant only to refer to relative positions and/or orientations, for convenience, and are not to be understood to be in any manner otherwise limiting.

While the aforementioned description of the present invention describes a fluid propulsion system, any propulsion system, such as a gas propulsion system, may be substituted.

What is claimed is:

1. A physical resistance training apparatus comprising:

a receiver that receives a pressurized flow of fluid having a selectable flow rate associated therewith;

an interface unit coupled to the receiver, said interface unit having a user pad with one or more grasping points and being moveable on three dimensional (x-y-z) axes of direction, said interface receiving the pressurized flow of fluid at the receiver to be discharged from the interface unit;

a coupled jet nozzle discharger located on the interface unit and coupled to the receiver, said jet nozzle discharging the fluid from the interface unit and variably controlling the direction of fluid in a selectable variable direction so as to generate a force in a direction opposite the direction of the flow of fluid, said user pad is capable of being controlled while grasped during the discharge of said fluid from the jet nozzle discharger, which provides a physical resistance training force during the discharge of fluid.

2. The apparatus of claim 1 further comprising a rate interface adapted to enable the selection of the rate of discharge of the fluid.

3. The apparatus of claim 2, wherein the rate interface is adapted to be controlled by at least one of the user of the apparatus, a person assisting the user in the user's use of the apparatus, and an electronic device adapted to automatically control the rate interface.

4. The apparatus of claim 1 further comprising the jet nozzle discharger is adapted to enable the selection of the direction of the discharge of the fluid.

5. The apparatus of claim 4, wherein the Jet nozzle discharger is adapted to be controlled by at least one of the user of the apparatus, a person assisting the user in the user's use of the apparatus, and an electronic device adapted to automatically control the rate interface.

6. The apparatus of claim 1, wherein the apparatus further comprises a source of pressurized fluid.

7. The apparatus of claim 1, wherein the user pad is adapted for transferring the force to the user by interfacing with at least one of a plurality of parts of a body of the user.

8. The apparatus of claim 7, wherein the user interface is adapted to interface with at least one of the user's head, foot, feet, hand, hands, arm, arms, leg, legs and torso.

9. The apparatus of claim 1, wherein the jet nozzle discharger is adapted to be moveable along at least one axis of direction.

10. The apparatus of claim 1, wherein the jet nozzle discharger can be fitted with different sized aperature outlets so as to vary the pressure of the fluid during the discharge thereof.

11. A physical resistance training device, comprising:

a pressurizer having an input and an output, said pressurizer increasing the pressure on a fluid after said fluid flows into said input, said high pressure fluid flowing out of the pressurizer's output;

an interface unit having a fluid flow input and a jet nozzle discharge output such that the interface transfers a rapid reaction force on a user pad associated with said interface unit, said user pad being moveable on three dimensional axes (x-y-z) of direction and having one or more grasping points, said interface unit receiving a high pressure fluid at its input from the output of the pressurizer and said high pressure fluid being discharged at the jet nozzle discharge output to produce said rapid reaction force to be controlled by the counterforce exerted on the interface unit user pad;

said rapid reaction force being generated by the discharge of the high pressure fluid at the jet nozzle discharge output of the interface unit wherein said discharge is variably controllable.

12. The training device of claim 11 wherein the rate of the flow of fluid can be controlled.

13. The training device of claim 11 wherein the direction of fluid discharge can be controlled.

14. The training device of claim 11 wherein the rapid reactionary force mimics the athletic forces encountered by linemen playing American football.

15. The training device of claim 11 wherein the interface is positioned on an overhead support mechanism that allows free movement of the interface unit along a horizontal plane.

16. A method of usiug a physical resistance training device comprising the steps of:

providing an interface unit having a user pad that has one or more grasping points and is moveable along three dimensional (x-y-z) axes of direction, said interface unit having an input and a jet nozzle discharge output, pressurizing a fluid with a pressurizer having an input and an output, said input receivng an unpressurized fluid and said output being coupled to the input of the interface unit;

providing the pressurized fluid to the input of the user pad from the output of the pressurizer;

discharging the high pressure fluid at the jet nozzle discharge output of the interface unit in a controlled direction and velocity of fluid flow to create a variable rapid reactionary force; and manipulating the interface unit user pad along multiple axes of direction to control the rapid reactionary force with a related counterforce.

17. The method of claim 16 wherein the rate of the flow of fluid can be controlled by a third party using a controller.

18. The method of claim 16 wherein the direction of fluid discharge can be controlled by a third party using a controller.

19. The method of claim 16 wherein the interface is positioned on an overhead support mechanism that allows free movement of the interface unit along a horizontal plane.

* * * * *